US005423139A

United States Patent [19]

Feldman

[11] Patent Number: 5,423,139

[45] Date of Patent: Jun. 13, 1995

[54] COMBINATION CARE AND INVENTORY LABEL

[75] Inventor: Joel D. Feldman, Santa Rosa, Calif.

[73] Assignee: Byer California, San Francisco, Calif.

[21] Appl. No.: 121,811

[22] Filed: Sep. 15, 1993

[51] Int. Cl.[6] ..... G09F 3/10

[52] U.S. Cl. ..... 40/299; 283/79; 283/105; 40/322; 2/115; 2/244; 2/243.1

[58] Field of Search ..... 40/299, 329, 366, 586; 283/79, 105, 81, 82; 2/243.1, 115, 244

[56] References Cited

U.S. PATENT DOCUMENTS

| | | | |
|---|---|---|---|
| 1,568,595 | 1/1926 | Freeman . | |
| 3,628,266 | 12/1971 | Wise | 40/299 |
| 4,260,656 | 4/1981 | Mullen | 283/81 |

FOREIGN PATENT DOCUMENTS

| | | | |
|---|---|---|---|
| 325515 | 7/1989 | European Pat. Off. | 40/299 |
| 1425035 | 12/1965 | France | 40/299 |
| 74779 | 2/1945 | Germany | 283/79 |
| 3538987 | 5/1987 | Germany | 283/80 |
| 3726928 | 2/1989 | Germany . | |

*Primary Examiner*—Kenneth J. Dorner
*Assistant Examiner*—Cassandra Davis
*Attorney, Agent, or Firm*—Baker & McKenzie

[57] ABSTRACT

A two-part garment label is provided. A first detachable part includes inventory information that may be separated along a perforation from the garment care part of the label that is sewn into the garment. The part of the label carrying the inventory information is then attached to the hanger supporting the garment by passing the hook of the hanger through an aperture in the inventory portion of the label. The inventory portion of the label is not separated from the garment care portion of the label until the garment is made ready for shipment or sale. The inventory portion of the label may display machine-readable inventory information and the accuracy of the machine-readable inventory information is ensured because it remains attached to the correct garment until the garment is made ready for shipment or sale.

7 Claims, 1 Drawing Sheet

10
11
14
13
22
16
12
15
23

10
11
17
14
16
12
18
30
21
23
12
15

26
14
11
22
25
13

30
28
Byer
27
12

COMBINATION CARE AND INVENTORY LABEL

FIELD OF THE INVENTION

This invention relates generally to the garment industry. Specifically, this invention relates to a combination care or washing instruction label and inventory label. A single sheet is printed with size and garment care instructions disposed on one side of a perforation and inventory information which may include a machine-readable bar code is disposed on an opposing side of the perforation. The label is sewn into the garment and the machine-readable bar code may be removed via the perforation and placed on to the garment hanger to facilitate the taking of inventory.

BACKGROUND OF THE INVENTION

In the garment industry, a significant amount of resources is spent on inventory control. Manufacturers and retailers alike need to keep close track of inventory in order to place new orders in a timely fashion and further to monitor theft. Many manufacturers employ inventory specialists at a substantial cost to take the inventory of a warehouse or facility. Other manufacturers will have employees take the inventory thereby increasing the labor cost associated with the manufacture of the garment.

One way to limit the amount of resources committed to inventory and inventory control is to manufacture garments that are, in fact, easier to inventory or to easier maintain perpetual garments entering and leaving a warehouse or other storage facility. One way to accomplish this is to improve upon the garment labels currently available so that the garment label sewn on to the garment at the factory also includes indicia to facilitate the taking of inventory. It is highly desirable to have the inventory information sewn onto the garment at the site of manufacture in order to insure that the correct inventory label is placed on the correct garment. Inventory labels placed on garments outside of the manufacturing area are often confused with similar labels resulting in the mislabeling of the garments and an inaccurate inventory.

SUMMARY OF THE INVENTION

The present invention provides an improved garment labeling system by providing a garment label that is separated into two parts by a tearable perforation or separation means. The first part of the label, disposed on one side of the perforation, includes indicia for the recording of inventory. In the preferred embodiment, the indicia will be in the form of a bar code and also includes the size of the garment. The second part of the label, disposed on an opposite side of the perforation from the first inventory part of the label, will include indicia indicating the size of the garment and preferably the care of the garment (i.e., machine washable, dry clean only, etc.).

The inventory information and the garment care information are preferably printed on the same side of the perforated sheet that comprises the two parts of the label. An outer edge of the second part of the sheet (the garment care part of the label) is sewn into the garment. When the garment is placed on a hanger, the factory worker tears the label along the perforation and then places the first part of the garment label on to the garment hanging means. In the preferred embodiment, the first part (inventory part) of the label includes an aperture. After the first part of the label is torn away from the second part of the label, a hook of the garment hanger or other garment hanging means may be passed through the aperture in the first part of the label and therefore the bar-coded label will be prominently displayed from the hook of the garment hanger. As the reader will visualize, a row of garments hung from hangers that prominently display the bar-coded inventory label on the hook of the hanger may be easily inventoried with a hand-held bar-code reading device similar to ones commonly used at check-out counters today.

In yet another preferred embodiment, a first two-part label is sewn into the garment and resembles the label described above. Then, a second label is sewn slightly above the garment care portion of the first label and serves as a cover for the garment care portion of the first label. This second label will preferably display a trademark or other information and serve as an aesthetically appealing cover for the garment care instructions disposed underneath.

The label made in accordance with the present invention is easy and inexpensive to manufacture and therefore the inventory control improvement provided by the present invention may be obtained without substantially altering current manufacturing processes. The label is preferably provided in roll form or in sheet form. Printing is required on only one side of the label. The perforation may be installed in the roll or sheet before or after the printing process. An outer edge of the label is sewn or otherwise attached to the garment with methods already known in the art. The inventory portion of the label may be separated from the garment care portion of the label at the factory, if the garments are shipped on hangers, or at the warehouse, if the garments are placed on hangers at the warehouse. It is preferable to separate the inventory control portion of the label at the factory to insure that the correct inventory label is associated with each garment.

It is therefore an object of the present invention to provide an improved garment label that includes size information, garment care information and inventory control information.

Yet another object of the present invention is to provide a two-part separable garment label that includes an inventory-control portion that may be separated from the garment at the factory, at the warehouse or storage or even at the store and placed directly on the garment hanger for accurate inventory control.

Other objects and advantages of the invention will become apparent upon reading the following detail description and appended claims, and upon reference to the accompanying drawings.

BRIEF DESCRIPTION OF THE DRAWINGS

This invention is illustrated more or less diagrammatically in the accompanying drawings, wherein.

Figures 1, 2, 3, 4, 5:
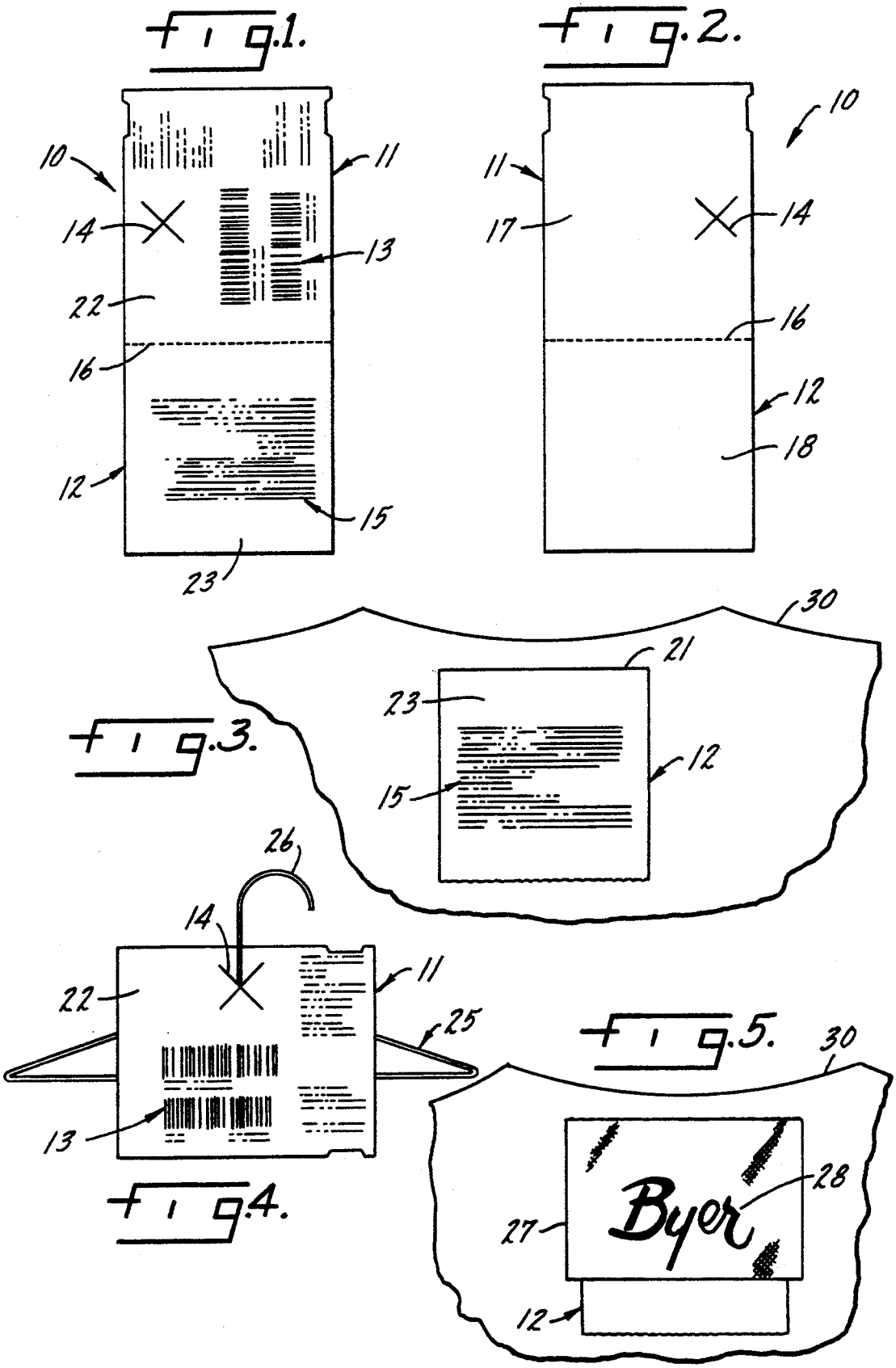
FIG. 1 is a front elevational view of a combination garment care-size-inventory control label as manufactured in accordance with the present invention.
FIG. 2 is a rear side view of the label shown in FIG. 1.
FIG. 3 is a front elevational view of the garment care and size potation of the label shown in FIG. 1 as sewn or otherwise attached to the garment and further with the inventory-control portion of the label removed therefrom.
FIG. 4 is a front elevational view of the inventory control portion of the label shown in FIG. 1 as attached to a garment hanger.
FIG. 5 is an illustration of an additional trademark-bearing label hingedly covering the garment care portion of the label shown in FIG. 3, both portions being sewn or otherwise attached to the garment.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Like reference numerals will be used to refer to like or similar parts from figure to figure in the following description of the drawings.

The improvement contributed by the present invention is best understood after consideration of the alternatives currently available. One way to inventory garments is to have a person manually count and categorize the garments. In order to lower the labor cost, automated methods of taking inventory are currently being introduced. However, if machine-readable or bar code devices are used, it is entirely possible that the wrong bar codes could be placed on a garment thereby adversely affecting the accuracy of the inventory. The present invention alleviates this problem by having the bar code or machine-readable code attached to the garment at the factory or place of manufacture. The machine-readable bar code is removed at the factory and placed on a hanger to which the garment is hung or the machine-readable bar code is removed at the warehouse or storage facility and placed on the hanger if the garment is shipped from the factory in boxes. In either instance, the bar code remains attached to the garment until the garment is placed on its own hanger and made ready for shipment to a retail outlet. The chance that the bar code and hanger could become separated or that the wrong bar code be placed on the garment are greatly reduced and the accuracy of the automated inventory process is improved.

FIG. 1 is an illustration of a two-part garment label 10 made in accordance with the present invention. The label 10 includes a first part 11 which provides inventory and size indicia and a second part 12 which provides garment care and materials information along with the size of the garment. Referring back to the first part 11, the preferred embodiment includes bar code information indicated generally at 13 which provides machine-readable inventory information such as price, color, size, origin, etc. Other information such as size, color and lot numbers may be provided in machine-readable and human-readable form. An perforation 16 is also provided which enables this first part 11 of the label to be detached from the second part 12 after the label is sewn into the garment. After the first part 11 is detached from the second part 12, the first part 11 may then be hooked over to the hook portion of a garment hanger or other garment hanging means.

Turning to the second part 12 of the label 10, garment care information 15 is provided in addition to the fabric materials, size, color and lot numbers. The perforation 16 divides the label 10 into the first part 11 and the second part 12.

FIG. 2 is a rear side view of the label 10 shown in FIG. 1. The rear surfaces 17, 18 may be used for the display of other indicia. For example, as seen in FIG. 3, the second part 12 of the label 10 is sewn into a garment 30 at its outer edge 21. Additional information may be provided for the consumer at the rear surface 18 of the second part 12 and the consumer can read this information by simply flipping the second part 12 upward thereby exposing the rear surface 18. It will be noted that the front surfaces 22, 23 of the label 10 shown in FIG. 1 and the rear surfaces 17, 18 of the label 10 shown in FIG. 2 are termed "front" and "rear" for illustration purposes only. Both sides of both parts 11, 12 may be used for the primary display of indicia and it is foreseeable that many manufacturers would want to include the garment care information 15 on the rear surface 18, or the surface facing the garment 30, as opposed to the outwardly facing surface 23 as shown in the embodiment illustrated in FIGS. 1 through 4. It will also be noted that the label 10 may be provided in the form of a continuous roll or in sheet form and may or may not be pre-perforated. A sheet may comprise one or more labels 10 and a roll may comprise a continuous separable stream of labels 10.

Turning to FIG. 4, as discussed above, the first part 11 of the label 10 may be detached at the factory, at the warehouse or at the store, depending upon the means of transporting the garments. After the first part or inventory portion 11 of the label 10 is torn along the perforation 16 and separated from the second part or the garment care portion 12 of the label 10, the first part 11 is attached to a hanger or other garment holding means 25 by passing the hook 26 through the aperture shown at 14. The garment 30 (see FIG. 3) is then hung or is already hung from the garment hanger 25.

FIG. 5 is an illustration of the use of a second label 27 which may display a trademark or style designation such as the one indicated at 28. The label 27 may serve as a convenient and aesthetically pleasing cover to the garment care information 15 disposed underneath.

Thus, an improved garment label is provided that provides the consumer with the necessary care and materials information and also provides the manufacturer with a machine-readable inventory label to facilitate the inventory process and to increase the accuracy of automated inventory processes. The inventory label 11 is not detached from the garment care label 12 until the garment 30 is made ready for shipment or for sale by placing it on to a garment hanger 25.

Although only one principal embodiment of the present invention has been illustrated and described, it will at once be apparent to those skilled in the art that variations may be made within the spirit and scope of the invention. Specifically, the label may be used by both the manufacturer and the retailer if an UPC (universal product code) bar code is employed that can be read by equipment utilized by both the retailer and manufacturer. Accordingly, it is intended that the scope of the invention be limited solely by the scope of the hereafter appended claims and not be any specific wording in the foregoing description.

We claim:

1. An improved garment care, size and inventory label, the label comprising:

a sheet of flexible and washable material divided into a lower first part and an upper second part by a perforation means, the first part having a front side and a rear side, the front side of the first part accommodating inventory indicia, the first part also including means for attaching the first part to a garment hanging means after separation of the first part from the second part, the second part having a front side and a rear side, the front side of the second part accommodating care and size indicia, an outer edge of the second part being sewn into a garment, the outer edge of the second part which is sewn onto the garment being disposed on an opposing side of the second part from the perforation means, the first part of the label being disposed below the perforation means and the second part of the label when the label is initially sewn onto the garment, the rear side of the second parts accommodating additional indicia, the perforation means enabling separation of the first and second parts with manual pressure.

2. The garment care, size and inventory label of claim 1, wherein the inventory indicia displayed on the front side of the first part includes a machine-readable bar code.

3. The garment care, size and inventory label of claim 2, wherein the means for attaching the first part to a garment hanging means includes an aperture for accommodating a hook.

4. The garment care, size and inventory label of claim 3, wherein both the front side of the first part and the front side of the second part includes size indicia.

5. A garment care, size, inventory and labelling system comprising:

a first label including a sheet of flexible and washable material divided into two parts by a perforation means, a first part having a front side and a rear side, the front side of the first part accommodating inventory indicia including a machine-readable bar code, the first part also including an aperture for attaching the first part to a garment hanging means after separation of the first part from the second part, a second part having a front side and a rear side, the front side of the second part accommodating care and size indicia, an outer edge of the second part being sewn onto a garment, the perforation means enabling separation of the first and second parts with manual pressure, rear sides of both the first and second parts accommodating additional indicia, the outer edge of the second part which is sewn onto the garment being disposed on an opposing side of the second part from the perforation means, the first part of the first label being disposed below the second part of the first label when the first label is initially sewn onto the garment, a second label being sewn over the second part of the first label, an outer surface of the second label for the display of trademark indicia, the outer surface of the second label providing an aesthetically pleasing cover for the care and size indicia displayed on the front side of the second part of the first label and disposed underneath the second label.

6. A method of labeling garments which facilitates the taking of inventory, the method comprising the following steps making a combination product information and inventory label, the label including a sheet of flexible and washable material divided into a first and second part by a perforation means, the first part having a front side and a rear side, the front side of the first part accommodating inventory indicia including a machine-readable bar code, the first part also including an aperture for attaching the first part to a garment hanging means after separation of the first part from the second part, the second part having a front side and a rear side, the front side of the second part accommodating care and size indicia, the perforation means enabling separation of the first and second parts with manual pressure, attaching an outer edge of the second part onto a garment, the outer edge of the second part being disposed on an opposing side of the second part from the perforation means and the first part of the label being disposed below the second part of the label when the outer edge of the second part is attached to the garment, placing the garment on a garment hanging means, tearing the first part of the label off of the second part of the label along the perforation means, placing the first part of the label on the garment hanging means and positioning the machine-readable bar code outward to facilitate the reading thereof.

7. The method of claim 6, further comprising the step of sewing a second label onto the garment over the second part of the combination product information and inventory label, an outer surface of the second label for the display of trademark indicia, the outer surface of the second label providing an aesthetically pleasing cover for the care and size indicia displayed on the front side of the second part of the combination product information and inventory label and disposed underneath the second label.

* * * * *